United States Patent [19]

Patel

[11] Patent Number: 4,483,692

[45] Date of Patent: Nov. 20, 1984

[54] PROCESS FOR THE RECYCLING OF COAL FINES FROM A FLUIDIZED BED COAL GASIFICATION REACTOR

[75] Inventor: Jitendra G. Patel, Bolingbrook, Ill.

[73] Assignee: Institute of Gas Technology, Chicago, Ill.

[21] Appl. No.: 461,443

[22] Filed: Jan. 27, 1983

[51] Int. Cl.[3] ..... C10J 3/06; C10J 3/54; C10K 1/02

[52] U.S. Cl. ..... 48/210; 48/206; 55/269; 55/435

[58] Field of Search ..... 48/206, 210; 55/269, 55/435

[56] References Cited

U.S. PATENT DOCUMENTS

| | | | |
|---|---|---|---|
| 2,098,024 | 11/1937 | Bailey | 55/269 |
| 2,448,553 | 9/1948 | Schutte et al. | 208/161 |
| 2,569,710 | 10/1951 | Fitzpatrick | 55/269 |
| 2,607,438 | 8/1952 | Bailey | 208/161 |
| 2,703,151 | 3/1955 | Glinka | 55/269 |
| 2,818,935 | 1/1958 | Kemmetmuller | 55/269 |
| 2,991,981 | 7/1961 | Andersen | 55/269 |
| 3,291,205 | 12/1966 | Harris et al. | 55/269 |
| 3,470,678 | 10/1969 | Clark et al. | 55/269 |
| 3,867,110 | 2/1975 | Schora et al. | 48/206 |
| 4,125,385 | 11/1978 | Rado et al. | 55/269 |
| 4,298,359 | 11/1981 | Keller et al. | 55/269 |
| 4,315,758 | 2/1982 | Patel et al. | 48/206 |

FOREIGN PATENT DOCUMENTS

| | | | |
|---|---|---|---|
| 508263 | 1/1952 | Belgium | 55/435 |
| 465897 | 10/1935 | United Kingdom | 55/269 |

*Primary Examiner*—Peter F. Kratz

*Attorney, Agent, or Firm*—Allegretti, Newitt, Witcoff & McAndrews, Ltd.

[57] ABSTRACT

A process for recycling coal fines and ash particles in the reaction effluent from a fluidized bed gasification reactor for further gasification is disclosed. Surfaces of the reactor exit pipeline, cyclone inlet pipeline and first stage cyclone are maintained at a temperature lower than that of the effluent through the use of cooling jackets, thereby preventing ash adhesion on the surfaces.

10 Claims, 2 Drawing Figures

PROCESS FOR THE RECYCLING OF COAL FINES FROM A FLUIDIZED BED COAL GASIFICATION REACTOR

BACKGROUND OF THE INVENTION

The present invention relates to a process for recycling coal fines and ash particles entrained in the reaction effluent from a fluidized bed reactor system for the gasification of coal back to the fluidized bed for further gasification. In particular, the present invention relates to a process for recycling coal fines and ash particles from a fluidized bed reactor system in which critical sections of the gasifier exit pipeline, the cyclone inlet pipeline and cyclones are water-jacketed to avoid adhesion and buildup of coal fines and ash particles that can result in the plugging and eventual shutdown of the gasification system.

In fluidized bed gasifiers, such as that illustrated in Patel, et al., U.S. Pat. No. 4,315,758, the teachings of which are incorporated herein by reference, a large amount of coal fines are entrained out of the fluidized bed along with the raw product gas that exits the gasifier at the top. In order to achieve high carbon conversion efficiencies, these coal fines have to be collected in cyclones and returned back to the fluidized bed for gasification. Generally, the cyclones, due to the high temperatures of the product gas, are refractory lined to avoid erosion problems and to protect the metal shell of the cyclones.

It has been found that some coal ash particles, present in the coal feed to the reactor, become entrained along with the coal fines and are also present in the raw product gas leaving the top of the gasifier. These ash particles contain high amounts of iron or calcium compounds that are sticky or soft at the temperatures encountered in the cyclone. Because of the impact of these particles on the inlet of the cyclone, the sticky ash particles adhere to the refractory lined interior surface of the cyclone and eventually buildup so that they obstruct the passage of gas and plug the cyclone resulting in a shutdown of the gasifier reactor system. Similar ash adhesion also occurs on surfaces of sharp turns or any other obstructions, such as areas of reactor size reduction, because of the ash particle-containing gases impacting directly on these surfaces, which are also typically refractory lined.

Ash studies have shown that the reason for the adhesion of the ash particles is due to the chemical nature of the ash, the temperature of the particles, and the direct impact of the ash particles on refractory lined surfaces. It has also been found that replacing the refractory liner with a plain metal surface does not avoid the problem of particles adhering to the surface as the metal surface rapidly reaches the same temperature as that of the gas.

The degree and amount of ash adhesion is a function of the nature of the ash contained in a particular coal. However, it has been found that coal having a high sulfur and, therefore, iron content have a greater tendency to adhere to the metal surfaces. The vast coal reserves of the eastern United States fall into this category. Therefore, for a fluidized bed gasification system to be able to successfully utilize these coals, a solution to the ash adhesion problem is required.

One method of solving the ash adhesive problem that has been proposed is to cool the entire stream of the raw product gas and the coal fines to a temperature below 1400° F., at which temperature the ash particles present in the coal fines do not adhere to surfaces on impact. This is achieved by spraying water or any other coolant in the top of the gasifier system to cool the gas to the above temperature as it exits the gasifier and enters the cyclone system. However, this method entails a considerable loss in overall efficiency in the gasification system. Once the gas is cooled, all of the sensible heat present in the gas cannot be recovered in the heat recovery system. Also, all of the coal particles present in the gas stream are cooled to the same temperature and, when returned to the fluidized bed reactor for gasification, require heating by combustion of additional amounts of coal and oxygen, thereby increasing operating costs. From this background, the present invention was developed.

SUMMARY OF THE INVENTION

It is an object of the present invention to provide an efficient process of recycling coal fines and ash particles from a fluidized bed gasification reactor back to the gasifier without encountering problems of ash adhesion and buildup in gasifier cyclones and downstream equipment, thereby facilitating the efficient operation of the fluidized bed gasification system.

It is another object of the present invention to provide a process for recycling coal fines and ash particles, as recovered from a fluidized bed gasification reactor wherein coal is converted to a gaseous product, back to the bed for further gasification.

It is still another object of the present invention to provide a process for the recycling of coal fines and ash particles to a fluidized bed gasification reactor in which metal surfaces in the gasifier exit pipeline, the cyclone inlet pipeline and the cyclone system are jacketed with a coolant which controls the surface temperature of the surfaces, thereby avoiding ash adhesion.

It is yet another object of the present invention to provide a process of recycling coal fines and ash particles to a fluidized bed gasification reactor which utilizes gas lines which are designed to avoid any sharp turns and thus minimize ash adhesion in such turns.

It has been discovered that coal fines and ash particles can be effectively recycled to a fluidized bed gasifier by cooling the surfaces on which the coal fines and ash particles impact rather than cooling the entire raw product gas stream. Only those particles which impact on critical surfaces are cooled thereby avoiding the necessity of cooling the entire mass of gas and solids. In this manner, only a minimum of heat is lost to the cooling surface and the bulk of the coal fines retain a high temperature when they are returned to the gasifier. This minimizes the need for additional combustion of coal with oxygen. When the soft, sticky ash particles impact on the cooled surfaces, their exterior is shock cooled and hardens, and, rather than sticking to the surface, they slide or bounce off. Most of the ash particles are then collected in a cyclone and returned to the gasifier for further conversion to gaseous products.

In a preferred embodiment of the present invention, the reaction effluent from a fluidized bed gasification system is passed into a gasifier exit pipeline in which the ash contact surfaces are maintained at a temperature lower than that of the effluent to prevent adhesion of coal fines and ash particles contained in the effluent on the inside surface of the pipeline. The effluent is then passed, via a cyclone inlet pipeline, into a first cyclone system in which the ash contact surfaces are maintained at a temperature lower than that of the effluent to also prevent adhesion of the coal fines and ash particles on the inside cyclone surface. The coal fines and ash particles separated from the effluent in the first cyclone system are recycled to the fluidized bed gasifier for further gasification. The effluent is then passed to a second cyclone system where remaining coal fines and ash particles are separated from the effluent and are recycled to the gasifier. The resulting product gas is then passed to a collection system.

These and other objects, features and advantages of the present invention will be set forth in the detailed description which follows.

DETAILED DESCRIPTION OF THE PRESENT INVENTION

Figure 1:
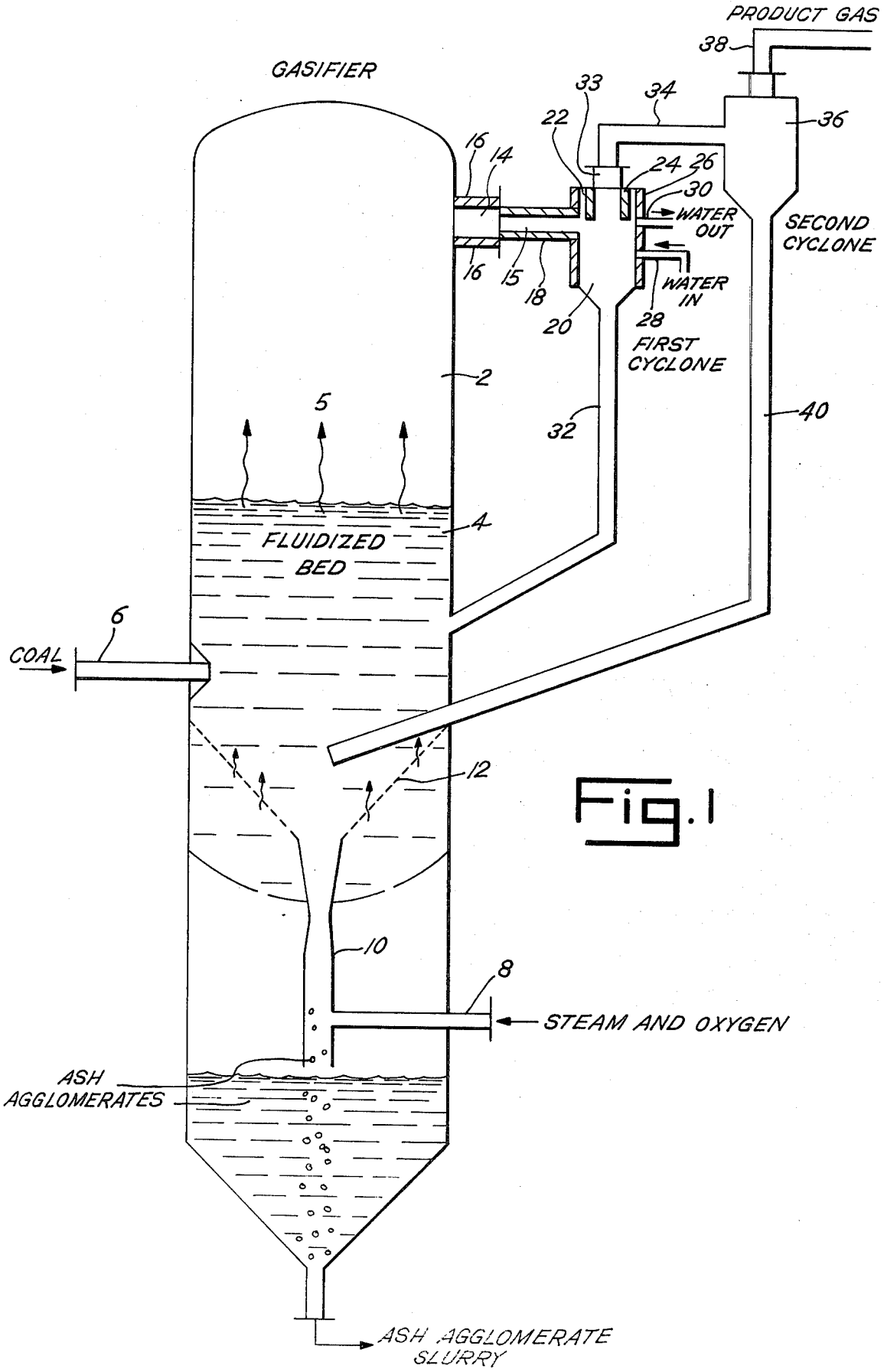
FIG. 1 is a schematic diagram of a fluidized bed gasification reactor system illustrating the principles of the present invention.

As illustrated in FIG. 1, gasification reactor 2 is a fluidized bed gasification reactor operated at conventional conditions of temperature and pressure for the conversion of agglomerating, solid, hydrocarbonaceous particles, preferably caking bituminous coal, to more valuable gaseous products, such as low BTU fuel gas, in fluidized reaction bed 4. Pulverized feed coal for gasification enters gasification reactor 2 through conduit 6 which extends a short distance into the fluidized bed 4 contained in the bottom portion of the reactor 2.

Fluidized bed 4 comprises an admixture of steam and oxygen (which enters from the bottom via line 8 through a venturi nozzle 10 and a sloping grid 12, which concentrically surrounds the venturi nozzle 10), fresh feed coal and char which, at reaction conditions produces a reaction effluent 5 comprising an admixture of carbon oxides, steam, hydrogen, hydrocarbons and entrained coal fines. Effluent 5 is removed from fluidized bed 4 through exit pipeline 14 and is passed via cyclone inlet pipeline 15 to first stage cyclone 20. Within cyclone 20, the coarse fines (about 20 to 250 microns in diameter) are separated from the product effluent and returned via line 32 directly to fluidized bed 4.

The overhead or gaseous effluent from cyclone 20 is removed from the top portion 33 of cyclone 20 via line 34 and is then passed to second stage cyclone 36 wherein additional fine material (about 5 to 100 microns in diameter) is recovered and passed via line 40 to a location within the bottom portion of fluidized bed 4. Product gas stream 38 is removed from the top portion of cyclone 36 for further treatment, partial recycle and/or use.

Figure 2:
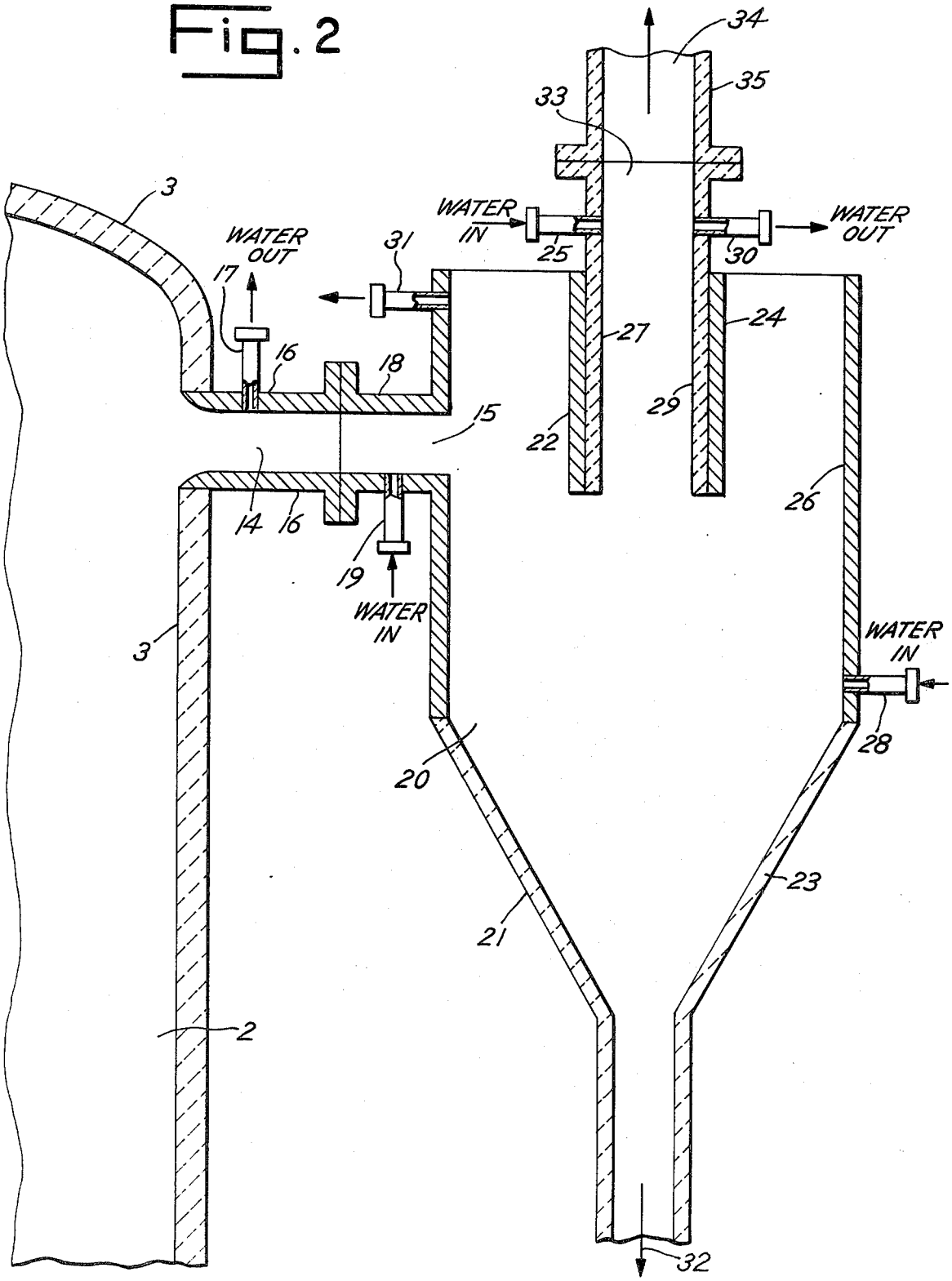
FIG. 2 is a detailed diagram of the upper portion of the gasification reactor system illustrated in FIG. 1 showing in detail the jacketing of surfaces in the gasifier exit pipeline, the cyclone inlet pipeline and the first cyclone system.

The process of the present invention is described in further detail by reference to FIG. 2. The reaction effluent 5, which contains entrained coal fines and ash particles and is at a temperature of between 1500° and 2300° F., a temperature range of 1700° to 2000° F. being preferred, passes, at a velocity of less than 150 feet/second, from gasification reactor 2, which is lined with refractory lining 3, through exit pipeline 14 into cyclone inlet pipeline 15. Pipelines 14, 15, which are designed without any sharp turns to avoid adhesion of coal fines and ash particles, are jacketed with cooling jackets 16 and 18 which maintain the interior surface of pipelines 14, 15 at a temperature lower than the temperature of the effluent 5. The temperature is maintained in the range of 400° to 1800° F., with 600° to 1200° F. being preferred. The cooling is accomplished by passing a coolant, via inlet 19 and outlet 17, through the jackets 16, 18 to effect a heat transfer with the interior surfaces of pipelines 14, 15 to prevent adhesion of the coal fines and ash particles on the surfaces. Suitable coolants are water, steam, air or other heat transfer media which provide a means of controlling the surface temperature of the pipeline surfaces. Water is the preferred coolant.

The effluent 5 containing the coal fines and ash particles then passes at the same velocity of less than 150 feet/second into the first cyclone system 20 where coal fines and ash particles are separated from the effluent 5. Cyclone 20 is refractory lined on surfaces 21, 23, 27, 29 and is jacketed with cooling jackets 18, 22, 24, 26 on the remaining surfaces. The cooling jackets maintain the jacketed surfaces at a temperature of 400° to 1800° F., which is lower than the temperature of the effluent, so that coal fines and ash particles which impact on these surfaces will not adhere to them and plug up the cyclone, thereby greatly impairing the efficiency of the gasification reaction. The cooling is effected in the same manner as described above by passing a suitable coolant through the jackets 18, 22, 24, 26 via inlets 19, 25, 28 and outlets 17, 30, 31. The coal fines and ash particles separated from effluent 5 in cyclone 20 are recycled back to fluidized bed 4 via line 32.

When the coal fines and ash particles impact on the cooled surfaces, their exterior is shock cooled and hardens. In the hardened state, the coal fines and ash particles will not adhere to the surfaces, but will slide or bounce off the surfaces. In this manner, the operating efficiency of the gasification reaction is maintained.

On the exterior coolant-side surfaces of jackets 16, 18, 22, 24, 26, a uniform temperature of 200° to 600° F. is maintained by circulating coolant, preferably water, into different sections of the jackets at flow rates which can be controlled individually at the inlets and outlets. In this manner the surfaces of pipelines 14, 15 and cyclone 20 contacting the interior gas-side surfaces of jackets 16, 18, 22, 24, 26 are maintained at the desired constant temperature. The temperature of the water in the jackets may be controlled to either generate steam or reject the heat to other cooling water (not shown). The water system may alternatively be a closed circulating system with a source for rejecting heat (not shown). If steam is being generated, the temperature level, within the 200° to 600° F. range, will be determined by the pressure of the steam being generated inside the jackets by the heat transfer taking place with the surfaces of pipelines 14, 15 and cyclone 20.

The effluent 5 then passes from cyclone 20 via cyclone outlet 33 into line 34, both of which are refractory lined with lining 35. Line 34 carries the effluent 5 into a second cyclone 36 which is maintained at the same temperature as that of the entering effluent 5. In cyclone 36, remaining coal fines and ash particles are separated from the effluent 5, thereby forming a product gas. The product gas exits cyclone 36 via line 38 and passes into a suitable collection system. Alternatively, the gas may be recycled for further treatment. The separated coal fines and ash particles are recycled via line 40 to the fluidized bed 4 for further gasification to reaction effluent.

The effect of the process of the present invention on adhesion of coal fines and ash particles in pipeline 14 and cyclone 20 is illustrated in the following examples:

EXAMPLE I

Reaction effluent 5 at a temperature of 1850° F. was passed from gasifier 2 into cyclone 20 where only cyclone inlet pipeline 15 was jacketed with jacket 18. Water was utilized as the coolant in jacket 18 to maintain the surface of pipeline 15 at 400° F. No other surfaces of cyclone 20 were so jacketed. It was found that there was no adhesion of coal fines or ash particles on the jacketed surface of pipeline 15. However, the unjacketed surfaces of cyclone 20 encountered significant ash adhesion.

EXAMPLE II

Reaction effluent 5 at a temperature of 1850° F. was passed from gasifier 2 into cyclone 20 via cyclone inlet pipeline 15. Pipeline 15 and cyclone 20 were jacketed by jackets 18, 22, 24 and 26 through which water was passed to maintain the jacketed surfaces at 400° to 800° F. It was found that adhesion of coal fines and ash particles was completely eliminated, thereby maintaining the overall efficiency of the reactor system.

It should be understood that the foregoing disclosure emphasizes certain specific embodiments of the present invention and that all modifications or alternatives equivalent thereto are within the spirit or scope of the invention as set forth in the appended claims.

What is claimed is:

1. A process for recycling coal fines and ash particles in the reaction effluent from a fluidized bed reactor system for the gasification of coal which comprises:

(a) passing said reaction effluent containing said coal fines and ash particles into a gasifier exit pipeline and a cyclone inlet pipeline;

(b) shock cooling and thereby hardening the exteriors of coal fines and ash particles which impact on at least a portion of contact surfaces of the gasifier exit pipeline and the cyclone inlet pipeline by actively maintaining at least the portion of the contact surfaces of said gasifier exit pipeline and said cyclone inlet pipeline at a temperature lower than the temperature of said reaction effluent entering the pipeline to substantially completely prevent adhesion of said coal fines and ash particles on the contact surfaces of said pipelines;

(c) passing said reaction effluent into a first cyclone system;

(d) shock cooling and thereby hardening the exteriors of coal fines and ash particles which impact on at least a portion of the inside surface of the first cyclone system by actively maintaining at least the portion of the inside surface of said first cyclone system at a temperature lower than said temperature of said reaction effluent entering the pipelines to substantially completely prevent adhesion of said coal fines and ash particles on the inside surface of said first cyclone system;

(e) separating coal fines and ash particles from said reaction effluent by said first cyclone system;

(f) recycling said coal fines and ash particles from said first cyclone system to said fluidized bed;

(g) passing said reaction effluent to a second cyclone system for further separation of said coal fines and ash particles from said reaction effluent, thereby forming a product gas;

(h) recycling said coal fines and ash particles from said second cyclone system to said fluidized bed for further gasification; and (i) passing said product gas to a collection system.

2. The process of claim 1 wherein said reaction effluent is at a temperature between 1500° and 2300° F.

3. The process of claim 2 wherein said reaction effluent is at a temperature between 1700° and 2000° F.

4. The process of claim 1 wherein said reaction effluent passes into said first cyclone system at a velocity of less than 150 feet/second.

5. The process of claim 1 including surrounding at least portions of said gasifier exit pipeline and said cyclone inlet pipeline and at least a portion of said first cyclone system with a jacket containing a heat transfer medium for cooling at least the portion of the contact surfaces and at least a portion of the inside surface.

6. The process of claim 5 wherein said heat transfer medium is selected from the group consisting of water, air, and steam.

7. The process of claim 5 wherein said jacket includes an interior gas-side surface and an exterior coolant-side surface and wherein said exterior coolant-side surface of said jacket is maintained at a uniform temperature between 200° and 600° F. thereby maintaining said surfaces of said pipelines and said cyclone at a constant temperature.

8. The process of claim 5 wherein at least said portions of said surfaces of said pipelines and said first cyclone system are maintained at a uniform temperature between 400° to 1800° F.

9. The process of claim 8 wherein said uniform temperature is between 600 and 1200° F.

10. The process of claim 1 wherein said second cyclone system is maintained at the same temperature as the temperature of said reaction effluent entering said second cyclone system.

* * * * *